United States Patent [19]

Inooka

[11] 4,340,466

[45] Jul. 20, 1982

[54] PROCESS FOR HYDROTREATING HEAVY OILS CONTAINING METALS

[75] Inventor: Masayoshi Inooka, Yokohama, Japan

[73] Assignee: Chiyoda Chemical Engineering & Construction Co., Ltd., Yokohama, Japan

[21] Appl. No.: 150,132

[22] Filed: May 15, 1980

[30] Foreign Application Priority Data

May 22, 1979 [JP] Japan ..... 54-62242

[51] Int. Cl.[3] ..... C10G 23/02

[52] U.S. Cl. ..... 208/210; 208/251 H

[58] Field of Search ..... 208/209, 210, 212, 251 H

[56] References Cited

U.S. PATENT DOCUMENTS

| | | | |
|---|---|---|---|
| 3,817,855 | 6/1974 | Smith et al. | 208/212 |
| 3,860,510 | 1/1975 | Henke et al. | 208/210 |
| 3,923,635 | 12/1975 | Schulman et al. | 208/108 |
| 4,017,382 | 4/1977 | Bonnell et al. | 208/210 |
| 4,048,060 | 9/1977 | Riley | 208/210 |
| 4,152,250 | 5/1979 | Inooka et al. | 208/213 |
| 4,166,026 | 8/1979 | Fukui et al. | 208/210 |

FOREIGN PATENT DOCUMENTS

| | | |
|---|---|---|
| 52-90503 | 7/1977 | Japan . |
| 53-98307 | 8/1978 | Japan . |
| 53-98308 | 8/1978 | Japan . |
| 53-101004 | 9/1978 | Japan . |
| 53-115703 | 10/1978 | Japan . |

*Primary Examiner*—O. R. Vertiz
*Assistant Examiner*—Wayne A. Langel
*Attorney, Agent, or Firm*—Armstrong, Nikaido, Marmelstein & Kubovcik

[57] ABSTRACT

A process for catalytically hydrotreating a heavy oil containing soluble metals in two steps at a temperature of 320° to 470° C. and a hydrogen pressure of 30 to 350 kg/cm$^2$, wherein the oil is substantially desulfurized in the first step in the presence of a first-step catalyst and then demetallized in the second step in the presence of a second-step catalyst, the desulfurization selectivity (as defined in the specification) of the first-step catalyst being higher than that of the second-step catalyst. According to this process, the metal content and the sulfur content of the treated oil can be prescribed at the desired levels, and a low-sulfur, low-metal oil can be obtained with a relatively small amount of hydrogen chemically consumed.

11 Claims, 4 Drawing Figures

PROCESS FOR HYDROTREATING HEAVY OILS CONTAINING METALS

BACKGROUND OF THE INVENTION

1. Field of the Invention

This invention relates to a process for hydrotreating a heavy oil containing soluble metals (to be referred to simply as "metals" hereinbelow) such as organometallic compounds. More specifically, this invention pertains to a novel two-step hydrotreating process for a heavy oil which comprises catalytically hydrotreating the heavy oil in two steps using a first-step catalyst zone comprising a catalyst having higher desulfurizing activity than demetallizing activity and a second-step catalyst zone having higher demetallizing activity than desulfurizing activity.

2. Description of the Prior Art

Heavy oils, especially residual oils from distillation of crude oils at an atmospheric or reduced pressure, contain in concentrated form almost all of metals, asphaltenes and residual carbon precursor substances which were present in the crude oil, and also have sulfur and nitrogen in high concentrations. Thus, these heavy oils have only limited applications. It is known that among the various hetero elements contained in heavy oils, metals constitute permanent poisoning substances on catalysts in the catalytic treatment of the heavy oils. Many methods have therefore been proposed in the past to remove these metals. These conventional hydrotreating methods, known generally as hydrodesulfurizing or hydrodemetallizing methods, are superior methods which can afford treated oils having low contents of metals, asphaltenes, sulfur and nitrogen in high yields. For use in these treating methods, there have been developed hydrodesulfurization catalysts supported mainly on an alumina or silica-alumina carrier and having sufficiently high desulfurizing activity and a long catalyst lifetime. These catalysts, however, are not always suitable for concurrent application to the demetallizing, or metal removal, of feed oils having a high content of metals. For example, when a hydrodesulfurized oil is used as a starting material for catalytic cracking, it is necessary to reduce the metal content of the stock to not more than 10 ppm, preferably to several ppm, beforehand in order to avoid degradation of cracking catalysts. Although it is known that such thorough demetallization is technically possible by performing thorough desulfurization under severe reaction conditions, such a thorough desulfurizing-demetallizing treatment with a desulfurization catalyst is undesirable because the amount of hydrogen chemically consumed increases markedly with an increase in the degree of desulfurization. It is noted in hydrodesulfurization of ordinary residual oils that the amount of hydrogen consumed chemically per unit amount of sulfur removed increases gradually at a desulfurization rate of 60 to 70% or more, and strikingly at a desulfurization rate of more than 80%, especially more than 90%. On the other hand, the sulfur content of the catalytic cracking stock is preferably low in order to reduce the amount of sulfur oxide in exhaust gases from a catalyst regenerating tower, but is not particularly limited for the purpose of obtaining light oils in high yields. The light oils produced in the catalytic cracking process can be easily hydrodesulfurized under mild reaction conditions with a small amount of hydrogen chemically consumed. Accordingly, when it is desired to obtain materials for catalytic cracking, etc. from heavy oils having large amounts of soluble metals, thorough demetallization, rather than desulfurization, of the heavy oils is required, and to prevent an increase in the amount of hydrogen consumed chemically in this case, it is rather preferred to decrease the rate of desulfurization. Another imperfection of the desulfurizing-demetallizing method using hydrodesulfurization catalysts is that these catalysts decrease in activity as the metals in the feedstock deposit thereon, and with it, the properties of the product oils, characterized by their sulfur and metal contents, vary continuously. In order to use the treated oils continuously as feedstocks for catalytic cracking, their properties are preferably maintained constant. Variations of the properties of the feedstocks are extremely undesirable because they result in variations in the operating conditions of the catalytic cracking process for these treated oils fed continuously and also in the properties, yields, etc. of the cracked products.

For use in the so-called hydrodemetallizing method, catalysts having a very long catalyst lifetime, such as sepiolite-type demetallizing catalysts, have been suggested. Methods utilizing these catalysts prove superior in demetallization of heavy oils because the use of these catalysts leads to a reduced amount of hydrogen chemically consumed. However, even the use of these long-life demetallizing catalysts causes gradual changing of the properties of the treated oils as the catalysts undergo degradation, although it is not as abrupt as is the case with the desulfurization catalysts. Furthermore, in thorough demetallization with demetallization catalysts, it is noted that a considerable amount of sulfur is also removed and an excessive amount of hydrogen chemically consumed is necessary. However, the degree of desulfurization cannot be kept at a desired level depending upon the properties of the feedstock oil. For this reason, the hydrodemetallizing method using demetallization catalysts which mainly induce demetallization is not entirely suitable for the demetallizing-desulfurizing treatment of heavy oils.

The present inventor already disclosed in Japanese Laid-Open Patent Publication No. 98308/1978 a so-called demetallizing-desulfurizing process characterized by using a combination of a desulfurization catalyst and a demetallization catalyst having specified properties. This process is based on the surprising experimental fact that while a direct desulfurizing catalyst having a large average pore diameter usually considered to be suitable for treatment of heavy oils is markedly susceptible to degradation in the hydrodesulfurization of demetallized oils, contrary to expectation from the conventional common knowledge, a catalyst for desulfurizing distillated oils which has a small average pore diameter rather has high activity and a long catalyst lifetime in the hydrodesulfurization of demetallized oils. This process is also based on the discovery that the content of metals in light fractions is especially decreased. It has also been noted that in the hydrodesulfurizing treatment of demetallized oils, the rate of demetallization is much lower than the rate of desulfurization, and fairly large amounts of metals remain in the heavy fractions even after the two-step treatment. In order, therefore, to markedly reduce the total metal level of the treated oil and also to reduce the sulfur level to a desired point, it is necessary to perform thorough demetallization in the hydrodemetallizing step and then to further desulfurize the demetallized oil. Such a thorough demetallizing treatment with hydrodemetallizing catalysts requires very severe reaction conditions as is the case with the thorough demetallizing treatment with hydrodesulfurization catalysts.

The inventor also disclosed in Japanese Laid-Open Patent Publication No. 90503/1977 a demetallizing-desulfurizing process in which at least a part of hydrogen sulfide formed in the step of desulfurizing a demetallized oil is recycled to the demetallizing step. This process is based on the discovery of the phenomenon that the activity of a demetallizing catalyst, contrary to the conventional common knowledge, contributes greatly to the increase of the partial pressure of hydrogen sulfide.

The present inventor made extensive investigations in order to apply these prior findings mainly to the production of product oils having a very low content of metals. These investigations finally led to the present invention.

SUMMARY OF THE INVENTION

It is an object of this invention to provide a process for easily obtaining a product oil having a very low content of metals by hydrotreating a heavy oil in a novel combination of two steps in which contrary to known processes, the heavy oil is first hydrodesulfurized and then demetallized in order to increase the partial pressure of hydrogen sulfide in the demetallizing step.

It is another object of this invention to use two catalysts having different desulfurization selectivities specified hereinbelow in the aforesaid process, one in the first step and the other in the second step.

The present invention provides, in a process for hydrotreating a heavy oil containing soluble metals in two steps at a temperature of 320° to 470° C. under a hydrogen pressure of 30 to 350 kg/cm$^2$, the improvement which comprises using a first-step catalyst having a desulfurization selectivity $\gamma 1$ in the first-step and a second-step catalyst having a desulfurization selectivity $\gamma 2$ which is lower than $\gamma 1$ in the first step, each of the desulfurization selectivities $\gamma 1$ and $\gamma 2$ being defined by the following equation:

$$\gamma(\text{i.e., } \gamma 1 \text{ or } \gamma 2) = (\ln So/S/\ln Mo/M)$$

wherein So and S mean the sulfur contents of the feed heavy oil and the treated oil respectively, and Mo and M mean the metal contents of the feed oil and the treated oil respectively.

In one aspect, there is provided a suitable catalyst for use in the first step of the aforesaid process, which comprises an alumina or alumina-silica carrier having a specific surface area of at least 80 m$^2$/g, a pore volume of at least 0.4 cc/g and an average pore diameter of 60 to 200 A, and supported thereon (a) 0.5 to 30% by weight of at least one of V, Mo and W and (b) 0.1 to 12% by weight of Ni or Co or both, the atomic ratio of metal (b) to metal (a) deposited [(b)/(a)] being from 0.1 to 0.8.

In another aspect, there is provided a suitable catalyst for use in the second step of the aforesaid process, which comprises at least one of sepiolite, attapulgite, bauxite, allophane and red mud.

DETAILED DESCRIPTION OF THE INVENTION

Figure 1:
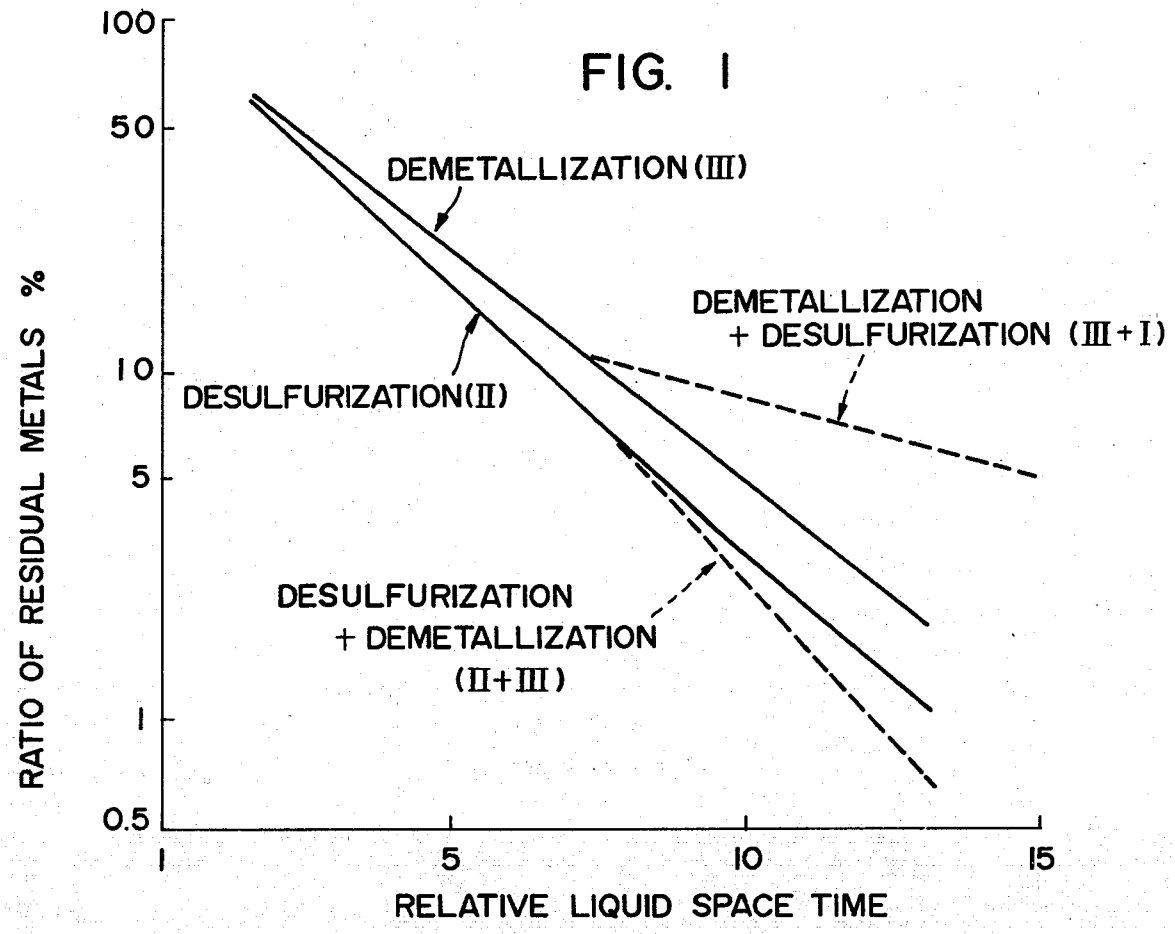
FIG. 1 is a graphic representation showing the results of demetallizing-desulfurizing treatment and desulfurizing-demetallizing treatment in comparison with those of demetallization treatment and desulfurization treatment alone in example 1 as the ratio of residual metals versus the relative liquid space time.

The major effects of treating a hydrodesulfurized oil with a hydrodemetallization catalyst are as follows:

(1) The demetallizing reactivity of the oil increases.

(2) When hydrogen sulfide formed in the desulfurizing step is fed into the demetallizing step, the activity of the demetallizing catalyst is increased.

(3) The desulfurization selectivity decreases and the demetallizing reaction occurs very selectively.

(4) It is very easy, irrespective of the degradation of catalysts in the respective steps, to keep the properties of the desulfurized demetallized oil, for example the ratio of metals to sulfur in it, constant only by the temperature control of the catalyst zone.

(5) The amount of hydrogen chemically consumed is small.

(6) The total liquid space time in the individual steps required to obtain a product oil of constant properties at a given catalyst life is substantially the same as, or shorter than, the liquid space time required when only a demetallizing catalyst is used.

The present invention also has the following advantages.

(1) The metal content and sulfur content of the treated oil can be kept at the desired levels, and a low-sulfur oil containing very low metal can be obtained with a relatively small amount of hydrogen consumed.

(2) Irrespective of the deterioration of the catalysts in the individual steps, the content of metals and sulfur in the product oil can be maintained constant over a long period of time by keeping the sulfur content of the treated oil fed from the first step at a constant value and keeping the metal content of the treated oil from the second step at a constant value using a simple operation of controlling the temperatures of the both catalyst zones.

The starting materials to be treated by the process of this invention may be any heavy oils containing large quantities of soluble metals. Examples of suitable starting oils are residual oils from distillation of crude oils at a atmospheric or reduced pressure, propane- or butane-deasphalted asphalt, and heavy crude oils having a high ratio of residual oils. As previously stated, these residual oils have a high content of metals, and low reactivity in demetallization. Hence, these oils cannot always be suitably treated by known hydrodesulfurizing methods, demetallizing methods or demetallizing-desulfurizing methods. According to the process of this invention, however, these feed oils can be easily treated.

Two types of catalysts having different desulfurization selectivities are used in the hydrotreating process of this invention. Supposing that hydrotreating of a heavy oil having a sulfur content of So and a metal content of Mo gives a treated oil having a sulfur content of S and a metal content of M, the desulfurization selectivity $\gamma$ of the catalyst is defined as follows:

$$\gamma=(\ln So/S)/(\ln Mo/M)$$

Investigations of the present inventor have shown that the desulfurization selectivity $\gamma$ of the catalyst is nearly constant irrespective of the reaction conversion, and that although $\gamma$ gradually varies with the degradation of the catalyst, $\gamma$ does not drastically change with the reaction conditions (e.g., the hydrogen pressure, temperature, etc.) and with the type of the starting material at least within a reaction time corresponding to one-fifth to one-half of the lifetime of the catalyst. The desulfurization selectivity $\gamma$, however, greatly varies with the type of the catalyst. For example, catalysts for hydrodesulfurization of residual oils supported on an alumina carrier have a $\gamma$ of about 0.7 to 1.2; desulfurization catalysts for distillated oils have a $\gamma$ of about 1.2 to 3; and demetallization catalysts have a $\gamma$ of less than 0.5, usually about 0.4 to 0.1. The inventor has also ascertained that the desulfurization selectivity $\gamma$ of a catalyst also correlates with its physical structure, and a desulfurization catalyst having a small average pore diameter and being susceptible to degradation by the deposition of metals has a high $\gamma$.

The desulfurization selectivity $\gamma$ also depends mainly upon the type and composition of a carrier and the types of metals supported thereon. Usual catalysts composed of alumina, alumina-silica or silica as a carrier and supported thereon, 0.1 to 30% by weight, preferably 0.5 to 10% by weight, as oxide, of at least one metal selected from Cu, Zn, Y and lanthanides have a very low $\gamma$. Known hydrodemetallizing catalysts, such as attapulgite, allophane, sepiolite, bauxite, manganese nodules, red mud, nickel ores and iron ores, molded articles of these, or catalysts composed of these and Cu, V, Mo, Ni, Co, etc. supported thereon, also have a very low $\gamma$ of usually about 0.1 to 0.3. From these desulfurization selectivity values, these catalysts are evidently used as so-called demetallizing catalysts.

In contrast, catalysts composed of alumina or alumina-silica as a carrier and supported thereon, (a) at least one member selected from the group consisting of V, Mo and W and (b) Ni, or Co, or both have a high desulfurization selectivity $\gamma$. This high $\gamma$ is evidence that these catalysts are usually employed as desulfurization catalysts.

In the hydrotreating process in accordance with this invention, the starting heavy oil is contacted successively with a first-step catalyst composed of a desulfurization catalyst and a second-step catalyst composed of a demetallization catalyst. Let the desulfurization selectivities of the first-step catalyst and the second-step catalyst be $\gamma_1$ and $\gamma_2$ respectively, then these catalysts are selected so that $\gamma_1$ is greater than $\gamma_2$. For use in the process of this invention, therefore, a desulfurization catalyst is selected as the first-step catalyst, and a demetallization catalyst is selected as the second-step catalyst. For some special purpose, it is possible to select only desulfurization catalysts or only demetallization catalysts as the first-step and second-step catalysts so long as $\gamma$hd $1>\gamma_2$. For example, such special-purpose catalysts are used for the thorough demetallization-desulfurization of oils having a high sulfur content and a low metal content, or thorough demetallization-desulfurization of oils having a high metal content and a low sulfur content.

The characteristic feature of the process of this invention can be fully exhibited by contacting the feed oil successively with the first-step catalyst and the second-step catalyst selected so as to satisfy the relation $\gamma_1>\gamma_2$. Preferably, the first-step and second-step catalysts are combined such that $\gamma_1\geqq 0.5$, preferably $0.65\leqq\gamma 1<3$, and $\gamma 2<0.5$, preferably $\gamma_2\leqq 0.35$.

The second-step catalyst desirably has a low $\gamma$ mainly because a catalyst having a lower $\gamma$ permits more selective demetallization in the demetallization treatment of a desulfurized oil, and a treated oil having constant properties can be more easily obtained irrespective of the degradation of the individual catalysts. On the other hand, the high desulfurizing activity is a main reason why the first-step catalyst desirably has a higher $\gamma$ than the second-step catalyst. Generally, as the $\gamma_1$ of the first-step catalyst is higher, the catalyst has higher activity but a shorter active lifetime. From the standpoint of activity and catalyst lifetime, it is preferred to use a catalyst with $0.65\leqq\gamma_1\leqq 1.5$, more preferably $0.75\leqq\gamma_1\leqq 1.0$.

$\gamma_1$ and $\gamma_2$ are desulfurization selectivities with respect to a fresh starting material.

Investigations of the present inventor have shown that the apparent desulfurization selectivity ($\gamma_{2'}$) of the second-step catalyst on a hydrodesulfurized oil is lower than its desulfurization selectivity $\gamma_2$ and as the rate of desulfurization in the first-step catalyst zone is higher, $\gamma_{2'}$ further decreases. It will be appreciated therefore that because in the process of this invention, a selective demetallization catalyst is chosen as the second-step catalyst and the desulfurized oil can be easily demetallized selectively, very selective demetallization takes place in the second step of the process of this invention.

In the process of this invention, it is impossible to avoid deposition of a considerable portion of metals removed from the feed oil on a desulfurization catalyst in the hydrotreating zone of the first step which is susceptible to degradation by metals, even when the catalyst has a high $\gamma$. Accordingly, although the process of this invention has many advantages, it might rather become disadvantageous as far as the catalyst life is concerned. It has been unexpectedly found however that when the desulfurization catalyst is used under such conditions that the rate of desulfurization is low, (1) the amount of metals which deposited until the catalyst is degraded is large and (2) coke deposition on the catalyst is reduced in the demetallizing treatment of the hydrodesulfurized oil, as compared with the case of operating the process at a relatively high degree of desulfurization and a high rate of demetallization, and therefore that the residual metals can be easily removed. When in the process of this invention, the ratio of the amount of the first-step catalyst to that of the second-step catalyst is high and demetallization is carried out to a very high rate in the first-step catalyst zone, the total amount of the catalysts consumed may sometimes be larger than in conventional processes. However, the total amount of catalysts can be reduced from that required in conventional processes by selecting the ratio between the amounts of the first-step and second-step catalysts according to the starting oil and the prescribed properties of the treated oil, and operating the process in each of the first-step catalyst zone and the second-step catalyst zone under optimal reaction conditions. Thus, the ratio between the first-step catalyst and the second-step catalyst is an important factor not only for the properties of the treated oil but also for the amount of the catalysts required. Usually, when it is desired to obtain a product oil containing a low sulfur and a low metal from a feed oil containing a high sulfur and a low metal, the ratio of the amount of the first-step catalyst to that of the second-step catalyst is preferably maintained high. The amount of the first-step catalyst is determined depending upon the required rate of desulfurization. When an oil containing a low sulfur and a low metal is to be obtained from a feed oil containing a low sulfur and a high metal, the ratio of the amount of the first-step catalyst to that of the second-step catalyst is maintained low in contrast to the case of obtaining a low-sulfur, low-metal oil from a starting oil containing a high sulfur and a low metal.

Generally, when the desired rate of desulfurization is set at x%, the rate of desulfurization in the first-step catalyst zone ($x_1$%) is preferably as follows: $0.8x \leqq x_1 < x$. The process of this invention is also suitable for the purpose of making the overall ratios of removal of metals and sulfur very high. It is especially suitable for attaining metal removal ratio of at least 80%, preferably at least 90% and a rate of desulfurization not more than 90%, preferably not more than 80%. This is because under these conditions, the synergistic effect of desulfurization and demetallization is especially great, the amount of hydrogen chemically consumed is relatively small, and the degradation of the catalyst in the first step is slight.

Broadly, the first-step and second-step catalysts are chosen such that $\gamma_1 > \gamma_2$. Preferably, there are catalysts having high desulfurizing activity and a long catalyst lifetime because the purpose of treatment in the first-step catalyst zone is to perform desulfurization and demetallization. For this reason, the first-step catalyst is suitably a so-called desulfurization catalyst comprising an alumina or alumina-silica carrier having a specific surface area of at least 80 $m^2/g$, preferably at least 120 $m^2/g$, a pore volume of at least 0.4 cc/g, preferably at least 0.5 cc/g, and an average pore diameter of 60 to 200 A, preferably 90 to 160 A, and supported thereon, 0.5 to 30% by weight, preferably 6 to 20% by weight, as oxides of (a) at least one member selected from the group consisting of V, Mo and W, preferably Mo alone, and (b) 0.1 to 12% by weight, preferably 1 to 8% by weight, of Ni or Co or both, the atomic ratio of (b) to (a) [(b)/(a)] being from 0.1 to 0.8, preferably from 0.2 to 0.6. Depending upon the purpose of treatment, the catalyst carrier may be alumina containing boria, phosphoric acid, titanium, etc. Generally, the first-step catalyst used in the process of this invention preferably has a long catalyst lifetime, a large pore volume and a large average pore diameter. Sometimes, however, there may be chosen a catalyst having high activity in usual hydrodesulfurization but having a short catalyst lifetime in the first step depending upon the properties of the starting oil, for example for treating a heavy oil having a high sulfur content such as Khafji vacuum distillation residual oils.

One characteristic feature of this invention resides in the use of a so-called demetallization catalyst having a low desulfurization selectivity as the second-step catalyst. Many catalysts have been known as such a demetallization catalyst. In the process of this invention, those having high demetallizing activity on hydrodesulfurized oils are selected rather than those which permit deposition of large amounts of metals. Preferably, such a highly active demetallization catalyst used in the second step of the process of this invention is a catalyst comprising at least one member selected from the group consisting of sepiolite, attapulgite, bauxite, allophane and red mud. Such a catalyst may be used directly or after it is molded and calcined. It is also possible to use it after supporting a metal such as Cu, V, Cr, Mo, W, Ni or Co thereon. An especially good catalyst for use in the second step, in its fresh state, contains silicon as a main ingredient of its chemical composition, the amount of silicon being at least 25% by weight, preferably at least 40% by weight, as oxide, and has a pore volume of at least 0.3 cc/g and an average pore diameter of at least 60 A, preferably at least 90 A. Examples of such a second-step catalyst are porous silica with or without a metal such as Cu, V, Mo, Ni and Co supported thereon, and porous magnesium silicate containing magnesium in addition to silicon, with or without metals supported thereon. The latter is especially suitable.

The present inventor disclosed in Japanese Laid-Open Patent Publication No. 113901/1977 a hydrotreating process which involves using a catalyst having porous magnesium silicate, especially a molded sepiolite article, as a carrier. The sepiolite-type catalyst also produces a very good result when used as a selective demetallization catalyst for hydrodesulfurized oils in the process of this invention. Hence, it is preferred to use as the second-step catalyst in the process of this invention natural sepiolite, synthetic sepiolite, porous products of these sepiolites obtained by kneading and molding, porous products of these obtained by eliminating part of magnesium by acid extraction, or products obtained by supporting metals on these materials. As the metals, at least one metal selected from metals of Groups Ib, IIb, IIIa, Va, VIa and VIII of the periodic table, preferably at least one metal selected from the group consisting of Cu, V, Mo, Ni and Co, more preferably a combination of at least one metal selected from the group consisting of V and Mo and at least one metal selected from the group consisting of Cu, Ni, and Co, is supported in an amount of 0.1 to 30% by weight, preferably 0.5 to 10% by weight, as oxides. Catalysts having as a carrier a product obtained by kneading and molding of sepiolite ore or a product obtained by adding an alumina sol, alumina-silica sol or silica sol to sepiolite ore and molding the mixture have especially high demetallization activity and therefore are very suitable as the second-step catalyst in the present invention.

It has further been found that by increasing the partial pressure of hydrogen sulfide in the second-step catalyst zone, the demetallizing activity of the second catalyst is increased further. One reason for this may be that as compared with a method of simply hydrodesulfurizing or demetallizing a fresh feed oil, the apparent desulfurization selectivity of the catalyst is further reduced in the step of demetallizing a hydrodesulfurized oil and therefore, the amount of desulfurization becomes very small to decrease the partial pressure of hydrogen sulfide; and thus the demetallizing activity can be increased by increasing the partial pressure of hydrogen sulfide. It is known that in the hydrogenolysis of a heavy oil containing a low sulfur or thorough desulfurization of this oil by a multi-step process, the conversion increases by adding hydrogen sulfide to hydrogen feed. Presumably, in the second-step catalyst zone in the present invention, hydrogen sulfide acts by a similar effect and action. Accordingly, in the present invention, too, the demetallization activity can be increased by positively increasing the partial pressure of hydrogen sulfide in the second-step catalyst zone. The suitable partial pressure of hydrogen sulfide varies depending upon the properties of the feedstock fed to the second-step catalyst zone, the reaction conditions, the type of the catalyst, etc. Usually, it is 0.1 to 50 kg/cm$^2$, preferably 0.3 to 15 kg/cm$^2$. In order to increase the partial pressure of hydrogen sulfide in the second-step catalyst zone substantially, any desired sources of hydrogen sulfide can be used. Since the reaction product gas from the first-step catalyst zone contains hydrogen sulfide gas, it is preferred to utilize this hydrogen sulfide continuously, and this constitutes another advantage of the process of this invention. When a sufficient hydrogen sulfide partial pressure cannot be obtained from the hydrogen sulfide from the first-step catalyst zone, a readily reactive sulfur compound such as carbon disulfide or mercaptan may be incorporated in the feedstock to the second-step catalyst zone. Usually, hydrogen containing hydrogen sulfide, or hydrogen sulfide alone, is fed. It is also possible to directly recycle the offgas from the second-step catalyst zone.

The reaction conditions in the first-step catalyst zone and the second-step catalyst zone in the process of this invention are selected as desired according to the properties of the feed oil and the prescribed properties of the product oil. To avoid marked deterioration of the catalysts and excessive chemical consumption of hydrogen, however, the reactions in these catalyst zones are carried out at a temperature of 320° to 470° C., preferably 350° to 430° C., under a hydrogen pressure of 30 to 350 kg/cm$^2$, preferably 70 to 200 kg/cm$^2$. The mode of reaction is optional, and any known modes such as a fixed bed type, a moving bed type or a ebullated bed type may be employed. Since, however, the first-step catalyst is more susceptible to degradation than the second-step catalyst, it may be advisable to provide the first-step catalyst zone as a zone which permits continuous exchange of catalyst, for example a moving bed or ebullated bed. If this type of catalyst bed is used in the first step, the feature of the very long life of the second-step catalyst can be fully exhibited, and product oils of the desired properties can be obtained from feed oils having a wide range of properties. Usually, however, the process of this invention is carried out in a fixed bed reactor both in the first step and the second step. This is because the desulfurizing-demetallizing process in accordance with this invention is free from the variations in the properties of product oils which occur with degradation of the catalyst in a conventional reaction method using a fixed bed, and it is very easy to maintain a constant level of not only the contents of sulfur and metals in the treated oil but also the contents of nitrogen, asphaltenes, residual carbon, etc. therein even when the individual catalysts undergo degradation.

The partial pressures of hydrogen in the first-step catalyst zone and the second-step catalyst zone are usually kept nearly the same, but if desired, they may be changed. Since the required amount of hydrogen chemically consumed in hydrodesulfurization is substantially proportional to the partial pressure of hydrogen, it is advantageous for reduction of the amount of hydrogen chemically consumed to maintain the hydrogen pressure in the first-step catalyst zone low and that in the second-step catalyst zone high. Investigations of the present inventor have also shown that a catalyst having a higher desulfurization selectivity is less susceptible to degradation at lower hydrogen pressures, and that surprisingly, the catalyst life is sometimes prolonged at low hydrogen pressures.

U.S. Pat. No. 3,860,510 states that in the production of an FCC feed material by the two-step hydrotreating of a heavy oil, the properties of the treated oil can be maintained constant irrespective of the degradation of catalysts by maintaining the hydrogen pressure in the first step high and the hydrogen pressure in the second step low and gradually changing the temperature with the passage of the reaction time. Surprisingly, contrary to this prior finding, it has been found in accordance with this invention that when the hydrogen pressure in the second-step catalyst zone is higher than that in the first-step catalyst zone, the properties of the product oil can be maintained constant irrespective of the degradation of the catalyst by simply controlling the temperature of the catalyst zone. This phenomenon which is quite contrary to that observed in the prior art is due presumably to the use of a demetallizing catalyst in the second-step catalyst zone in the process of this invention. Accordingly, it is very preferable to maintain the hydrogen pressure low in the first-step catalyst zone and high in the second-step catalyst zone in the process of this invention because not only does this lead to the reduction of the amount of hydrogen chemically consumed, but also gradual increasing of the temperature in each of the catalyst zones serves to keep a constant sulfur content in the first step and a constant metal content in the second step and to afford a product oil having constant properties. The difference in hydrogen pressure between the first-step catalyst zone and the second-step catalyst zone can be determined as desired depending upon the properties of the feed oil, the reaction conditions and the types and properties of the catalysts. Usually, it is about 10 to about 50 kg/cm$^2$.

The hydrotreated oil obtained in accordance with this invention can be directly used as a fuel oil because it has a very low content of metals and reduced contents of sulfur, nitrogen, asphaltenes and residual carbon. However, in view of the fact that the properties of the treated oil are maintained constant irrespective of the degradation of the catalysts and the amount of sulfur in the oil is relatively large as compared with metals and asphaltenes, it is very suitable as a feedstock for catalytic treating processes such as hydrocracking, hydrodesulfurization, or catalytic cracking. For example, the process of this invention, when used in place of the demetallizing treatment in the hydrocracking process described in the inventions by the present inventor described in Japanese Laid-Open Patent Publication Nos. 98307/1978 and 101004/1978, is very effective for easily converting heavy oils having a high content of metals into light oils. It is also very effective to apply the process of this invention in place of the demetallizing treatment in the demetallizing-desulfurizing process described in Japanese Laid-Open Patent Publication No. 98308/1978 cited hereinabove.

The treated oil containing metals and sulfur reduced to the desired contents by the process of this invention, if desired, may be subjected to known methods for removing nitrogen, residual carbon, etc.

In a catalytic cracking process, the feed oil is mixed with a large excess of a powder catalyst and cracked in a riser at 430° to 530° C. and in a reaction tower. On the other hand, the catalyst having coke deposited thereon is separated from the cracked gas, and recycled to a calcination regenerator tower. Usually, the yield of coke is about 1.2 to 2.0 times that of residual carbon. When the amounts of metals such as vanadium and nickel deposited on the catalyst increases, the yield of coke increases progressively, and further the yield of the gas increases with a decrease in the yield of the cracked oil. Accordingly, when the amount of metals in the starting material is large, the spent catalyst is withdrawn and a fresh catalyst is supplied in order to maintain the amount of metal deposits on the cracking catalyst at a fixed level. Since the treated oil obtained by the process of this invention has a very low content of metals, the amount of metals in the cracking catalyst can be maintained at less than 5000 ppm, usually 2000 to 3000 ppm. The amount of coke on the catalyst separated from the reaction tower is maintained at several percent in order to keep a sufficient activity and selectivity. In the treatment of a feed oil containing a high content of residual carbon, therefore, the proportion of the catalyst at the riser section increases. The catalyst having coke deposited thereon is recycled to the calcination regenerator tower. Because the yield of coke is high in the catalytic cracking of heavy oils, a part of the amount of heat generated in the regenerator tower is recovered as excessive steam. Usually, silica-alumina having a particle diameter of about 40 to about 80 microns and containing several % to 20% of an ion-exchange type x- or y-zeolite is preferred as a catalyst used in the catalytic cracking of the treated oil obtained by the process of this invention. The treated oil obtained by the process of this invention is also very desirable as a material for solvent deasphalting because its properties are constant irrespective of the degradation of the catalysts. The asphaltene content reduced in the first-step catalyst zone is further markedly decreased in the second-step catalyst zone, and moreover, the rate of asphaltene cracking in the first-step catalyst zone can be made higher as a catalyst having a lower desulfurization selectivity $\gamma$ is used. Hence, the deasphalting treatment is effectively carried out. Accordingly, when a solvent deasphalting step is to be combined with the hydrotreating process in accordance with this invention, $0.75 \leqq \gamma \leqq 1.0$ is preferred in order to obtain a low-metal oil in a high yield. In Japanese Laid-Open Patent Publication No. 115703/1978, it is pointed out that a treating oil having a higher rate of demetallization in the demetallizing step leads to a deasphalted oil having a higher rate of reduction in the content of metals when the yield of the deasphalted oil is the same. A similar phenomenon is observed in the solvent deasphalting treatment of a desulfurized and demetallized oil obtained in accordance with this invention. Since according to the process of this invention, it is easy to keep the contents of metals, asphaltenes and sulfur in the treated oil at the desired levels within broad ranges, when it is desired to produce a low-metal oil and asphalt simultaneously by solvent-deasphalting of the treated oil, the hydrotreating conditions and solvent deasphalting conditions can be chosen according to the uses and the designed properties of these products. For example, when it is desired to obtain an ultra-low metal and low-sulfur deasphalted oil suitable for use in a catalytic cracking process in a high yield from an oil containing a high sulfur, a high metals and a high asphaltenes content such as Middle East vacuum distillation residual oils, most of the metals and asphaltenes in the feed oil may be removed, and sulfur may be reduced to a predetermined level, in the hydrotreating process in accordance with the process of this invention, and then the treated oil may be subjected to deasphalting treatment with a solvent having a relatively large carbon number.

In the solvent deasphalting process, known methods and apparatus are used. Usually, hydrocarbons having 3 to 4 carbon atoms are selected as the solvent. When the hydrotreated oil obtained by the process of this invention is used as a starting material, a deasphalted oil having a very low metal content can be obtained even when a solvent having a relatively large number of carbon atoms, such as butane, pentane and hexane is used, and the yield of the deasphalted oil is very high. The solvent deasphalting is carried out at a temperature of 10° to 300° C. and a pressure of 1 to 50 kg/cm$^2$ with the solvent ratio maintained at from 1 to 20. When a hydrocarbon solvent having a large number of carbon atoms, such as pentane or hexane, is used, the deasphalting is carried out at a temperature of 150° to 250° C. and a pressure of 15 to 40 kg/cm$^2$ while maintaining the solvent ratio at from 1 to 10.

The combination of the hydrotreating process in accordance with this invention and the solvent deasphalting process is much superior to the conventional demetallizing-deasphalting process or the desulfurizing-deasphalting process. Specifically, since the properties of the hydrotreated oil are maintained quite constant, deasphalting treatment of this oil gives a product of constant quality in a substantially constant yield. This is very suitable for the upgrading treatment of such products. Furthermore, because a treated oil having extremely low metal and asphaltene contents can be easily obtained in the hydrotreating process, its deasphalting treatment easily leads to the formation of an oil having an ultralow metal content in a high yield. In the conventional hydrodemetallization-solvent deasphalting treatment, a high-sulfur deasphalted oil and deasphalting asphalt containing a relatively low sulfur are obtained. In constrast, since in the process of this invention, the sulfur contents of the deasphalted oil and deasphalting residue can further be reduced to the desired levels, it is easy to reduce sufficiently the sulfur content of the asphalt resulting from deasphalting. Such a low-sulfur asphalt is very suitable not only as a raw material for carbon materials but also as a mixing base material for low-sulfur fuel oils.

To sum up, the hydrotreating of a heavy oil in accordance with this invention comprises selecting a first-step catalyst and a second-step catalyst such that the desulfurization selectivity $\gamma_1$ is greater than the desulfurization selectivity $\gamma_2$, and desulfurizing the oil in the first step using the first-step catalyst and then demetallizing the hydrodesulfurized oil in the second step using the second-step catalyst. The sequence of treating steps is quite contrary to that in the conventional processes, but the process of this invention exhibits the following outstanding characteristic features.

(1) Thorough demetallization is easy, and the sulfur content of the treated oil can be kept at the desired level.

(2) Irrespective of the degradation of the individual catalysts, a treated oil keeping constant properties can be obtained.

(3) The required amount of hydrogen chemically consumed in the thorough demetallization is small.

The following Examples illustrate the process of this invention in detail. It should be understood that the novel process of this invention is in no way limited to these speific Examples, and may include a combination with the catalytic cracking process, the solvent deasphalting process, etc. shown hereinabove in the specification.

All proportions such as percentages and ppm given in these Examples are by weight unless otherwise specified.

EXAMPLE 1

A residual oil from atmospheric distillation having the properties shown in Table 1 was hydrotreated using the three types of catalysts shown in Table 2.

Catalysts I and II are hydrodesulfurization catalysts for distillated oils and residual oils respectively having alumina as a carrier. Catalyst III is a highly active demetallization catalyst obtained by pulverizing sepiolite occurring in Spain, adding a large quantity of water, kneading the mixture, and supporting catalytic metals on the resulting porous magnesium silicate carrier. The desulfurization selectivities ($\gamma$) of these catalysts shown in Table 2 were obtained when they were used in treating the residual oil shown in Table 1 at a temperature of 400° C. and a liquid space velocity of 0.25 to 4 $hr^{-1}$ while maintaining the partial pressure of hydrogen at 140 $kg/cm^2$.

TABLE 1

| | |
|---|---|
| Soluble metals (V + Ni + Fe) | 177 ppm |
| Sulfur | 2.62% |
| Nitrogen | 0.36% |
| n-Heptane-insoluble matter (asphaltenes) | 3.0% |
| Conradson carbon | 8.9% |

TABLE 2

| Catalyst (Use) | I (For Desulfurization of distillated oil) | II (For Desulfurization of residual oil) | III (For Demetalization) |
|---|---|---|---|
| Desulfurization selectivity ($\gamma$) | 1.6 | 0.85 | 0.18 |
| Specific surface area (nitrogen adsorption method, $m^2/g$ | 289 | 213 | 171 |
| Pore volume (mercury penetration method), cc/g | 0.488 | 0.600 | 0.790 |
| Average pore diameter, A | 68 | 113 | 185 |
| Major chemical constituents (%) | | | |
| $MoO_3$ | 15.7 | 14.8 | 6.9 |
| CoO | 3.8 | 3.8 | 1.9 |
| NiO | 1.8 | 1.7 | — |
| $Al_2O_3$ | 78.7 | 79.7 | — |
| $SiO_2$ | — | — | 48.8 |
| MgO | — | — | 18.6 |

The hydrotreatment was performed in an ordinary high-pressure flow-type reactor at a temperature of 400° C. and a hydrogen pressure of 140 $kg/cm^2$ at varying liquid space velocities (or liquid space times). To avoid treating in the initial activity region, each of the catalysts was sulfided using a gas oil and aged at a liquid space velocity of 0.5 $hr^{-1}$ for about 200 hours treating the feed oil in Table−1.

The co-relation between the content of residual metals in the treated oil and the relative liquid space time is shown in FIG. 1. In FIG. 1, the solid lines shown as demetallization (III) and desulfurization (II) respectively show the above relation in the case of using the catalyst III and II. The slightly lower gradient of the straight line for catalyst III than that for catalyst II is due to the fact that the demetallizing activity of catalyst III is slightly inferior to that of catalyst II. The line for catalyst II has a slightly mild gradient at a high conversion, and it is seen from this that a catalyst having a higher desulfurization selectivity shows a greater change in gradient at a high conversion. The dotted line for demetallization+desulfurization (III+I) shows the relation between the ratio of residual metals based on the fresh material and the total liquid space time in the case of treating the feed oil using catalyst III at a relative liquid space time of about 7.5 and desulfurizing the resulting hydrodemetallized oil using catalyst I. This dotted line shows that the content of metals is extremely difficult to reduce in the desulfurization of the demetallized oil.

When the desulfurizing catalyst II having a larger pore diameter was used in the experiment of desulfurizing the demetallized oil, the sulfur content and the metal content reduced nearly at the same rate. But the activity of catalyst II was greatly reduced, and its catalyst lifetime was much shorter than that of catalyst I. Furthermore, analysis of the spent catalyst II showed that the amount of coke deposited on catalyst II was much larger than in the case of treating a fresh feed oil. It can be assumed from this that although the catalyst II having a low desulfurization selectivity can be technically used for the desulfurization-demetallization of the demetallized oil, its catalyst life is short and therefore such a catalyst is not practical.

Figure 2:
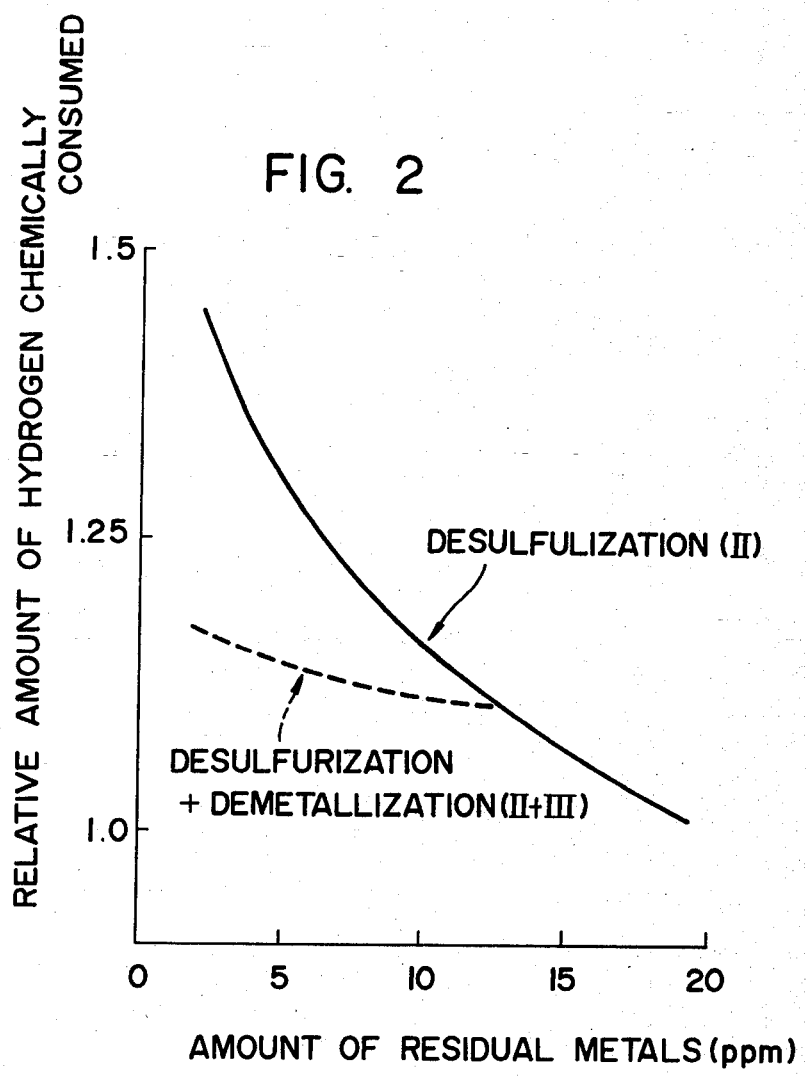
FIG. 2 is a graphic representation showing the effects of desulfurization treatment alone and desulfurization-demetallization treatment in Example 1 as the amount of residual metals versus the relative amount of hydrogen chemically consumed.

As shown in FIG. 1, thorough demetallization is possible by using catalyst II or III alone. But as shown in FIG. 2, when only the catalyst II is used, the amount of hydrogen chemically consumed increases greatly. When only the catalyst III is used, the sulfur level of the treated oil does not decrease to the desired value. Thus, both of these methods have their own merit and demerit. On the other hand, as is seen from the dotted line for desulfurization+demetallization (II+III), when the desulfurized oil was hydrodemetallized, the content of residual metals was reduced further, and the degradation of the catalyst was reduced. In this experiment, the desulfurized oil was separated from the product gas containing hydrogen sulfide, and was demetallized with fresh hydrogen. When in a another experiment, the desulfurized oil was passed directly through the demetallization catalyst zone without separating it from hydrogen sulfide, etc., it was noted that the contents of metals and asphaltenes in the product oil were reduced to a greater extent than in the former experiment although there was scarcely any difference in the sulfur content of the treated oil between these two procedures. Thus, it is seen that the effect of hydrogen sulfide is also great in the demetallization treatment of the desulfurized oil. Also, in view of the fact that in the process of this invention, hydrogen sulfide generated in the first-step catalyst zone can technically be fed easily to the second-step catalyst zone, it will be appreciated that the process of this invention is excellent as a desulfurizing-demetallizing method. In the experiment of desulfurization+demetallization (II+III) shown in FIG. 1, the desulfurized oil was scarcely desulfurized in the demetallizing step, and the apparent desulfurization selectivity was about 0.06.

In FIG. 2, the dotted line shows the relation between the amount of residual metals in the treated oil obtained by the process of this invention and the amount of hydrogen chemically consumed, and the solid line shows the result obtained when the treated oil demetallized to a metal content of 20 ppm was hydrotreated with catalyst II. In this graph, the abscissa represents the amount of residual metals. As is well known, when metals are removed, the content of asphaltenes are also reduced markedly. It will be readily appreciated therefore that the relation shown in FIG. 2 well approximates that between the amount of residual asphaltenes and the amount of hydrogen chemically consumed. It is seen from FIG. 2 that according to the demetallizing-desulfurizing process using a desulfurization catalyst for residual oils, the amount of hydrogen chemically consumed increases strinkingly especially when the content of residual metals is markedly reduced. By contrast, according to the process of this invention, the increase of the amount of hydrogen chemically consumed is much less than that in the demetallizing-desulfurizing method when it is strongly desired to remove metals, because the degree of desulfurization can be kept at the desired value in the process of this invention. The foregoing results demonstrate that the process of this invention is suitable for the thorough demetallization of heavy oils having large proportions of metals, the degree of desulfurization can be kept at the desired value, and the amount of hydrogen chemically consumed is small.

EXAMPLE 2

The same starting material as used in Example 1 was desulfurized and demetallized using the catalysts II and III shown in Example 1 so that the amount of metals in the treated oil reached 17 to 19 ppm, and the amount of sulfur in its reached 1.1 to 1.20%. Variations in the ratio of the amount of residual metals (ppm) to the amount of sulfur (%) with degradation of the catalysts were examined. For the sake of reference, the same treatment was attempted using a demetallizing catalyst III' having sepiolite as a carrier which had much the same properties as catalyst III but a slightly higher desulfurization selectivity. For easy comparison, this referential experiment was carried out at the same liquid space time as the experiment with desulfurization+demetallization (II+III).

Figure 3:
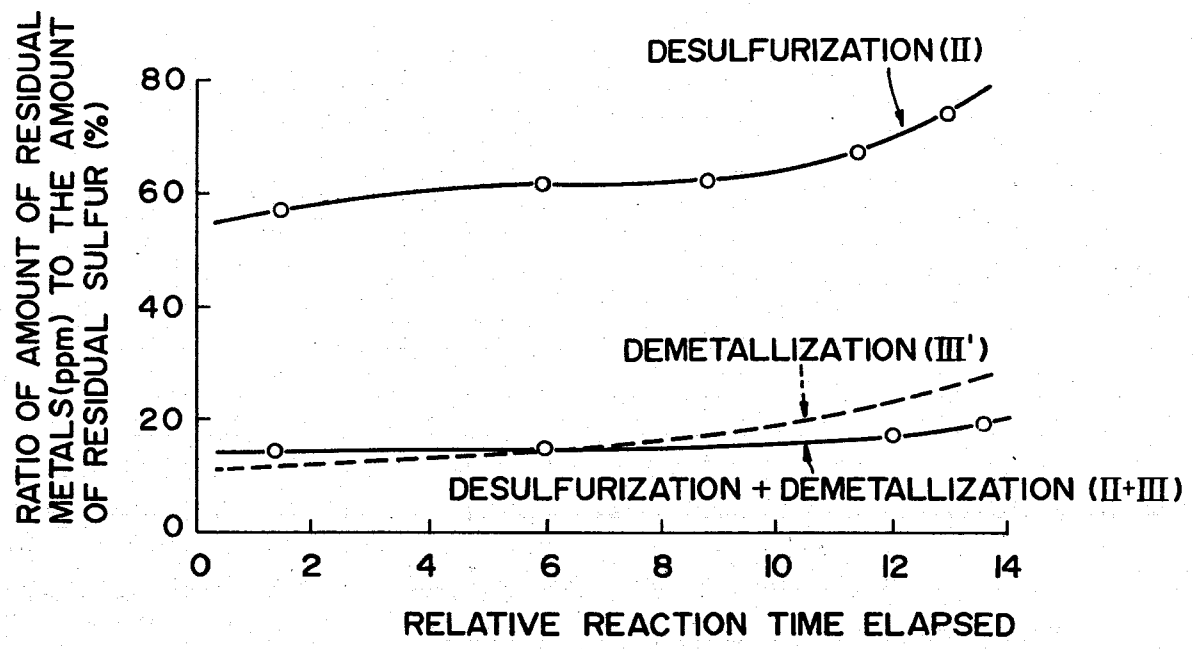
FIG. 3 is a graphic representation showing the ratio of the amount of residual metals to the amount of residual sulfur in each of the steps of the desulfurizing-demetallizing treatment in Example 2 versus the relative reaction time elapsed.
Figure 4:
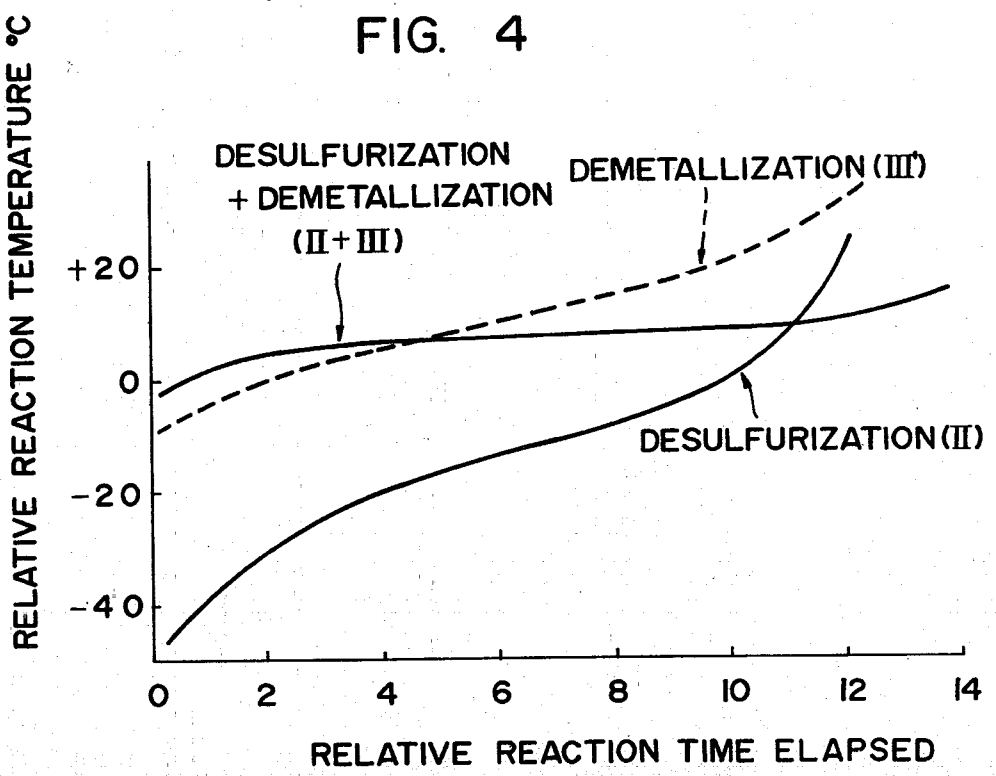
FIG. 4 is a graphic representation showing the variations in relative reaction temperature versus the relative reaction time elapsed in each of the steps in the desulfurizing-demetallizing treatment in Example 2.

FIG. 3 shows the variations in the ratio of the amount of metals (ppm) to the amount of sulfur (%) versus the relative reaction time elapsed in the treated oil in each process, and FIG. 4 shows the variation in the relative reaction temperature versus the relative reaction time elapsed.

It is seen from FIG. 3 that in the desulfurizing process, the metal/sulfur ratio in the desulfurized oil gradually increases with degradation of the catalyst, but this ratio is almost constant in the case of desulfurization+demetallization (II+III). This is because as shown in Example 1, in the demetallization of the desulfurized oil, the apparent desulfurization selectivity $\gamma$ is extremely low, and very selective demetallization treatment is carried out. However, in the treatment with demetallization catalyst III' alone, the ratio of residual metals (ppm)/sulfur (%) in the treated oil gradually increases with degradation of the catalysts as is the case with the desulfurizing (II) process, and therefore, a product oil having constant properties cannot be obtained.

It is noted from FIG. 4 that although the degradation of the catalyst in the desulfurization (II) process is very great, the reaction temperature is lower by 20°-40° C. than in the process of demetallization (III') alone. As is well known, the amount of hydrogen chemically consumed increases as the reaction temperature becomes higher, because hydrogenolysis, etc. occur. It is presumed that in the desulfurization step by the process of this invention, selective desulfurization is carried out because of the relatively low reaction temperatures, and therefore the amount of hydrogen chemically consumed is small. It is noted that the degradation of the catalysts in the demetallization of desulfurized oil (II+III) is milder than in the desulfurization process, and moreover, the reaction temperature is somewhat lower than in the process of demetallization (III') alone. It is presumed that because the desulfurized oil can be easily demetallized and the deposition of coke and metals on the catalysts is reduced, the high activity of the catalysts can be maintained. In FIG. 4, the relative LHSV was 1.0 in the process of demetallization (III') alone, 1.89 in the process of demetallization of the desulfurized oil (II+III), and 2.12 in the process of desulfurization (II).

It is seen from this Example that since even in the desulfurization-demetallization treatment of a starting material having a very high content of metals, deterioration of the catalysts by metals is reduced, the amount of the catalysts required and the liquid space reaction time are nearly the same as, or rather smaller and shorter than, in the case of using only a demetallization catalyst having a long catalyst lifetime. This is presumably because when a desulfurization catalyst is used in desulfurization treatment under relatively mild conditions, the life of the catalyst is much prolonged, and the desulfurized oil is relatively easy to demetallize, and the catalyst is not easily degradaded.

In order to show that the process of this invention not only exhibits superior results in demetallization and desulfurization treatment but also is effective in reducing the contents of asphaltenes and residual carbon, the present Example was performed using a relative reaction time of about 6.0. The properties of the treated oil are shown in Table 3.

TABLE 3

| | Desulfurization + demetallization (II + III) | Demetallization (III') |
|---|---|---|
| Amount of hydrogen chemically consumed (l/l) | 46 | 52 |
| Metals (ppm) | 19 | 18 |
| Sulfur (%) | 1.17 | 1.20 |
| Nitrogen (%) | 0.27 | 0.31 |
| n-Heptane insoluble matter (%) | 1.00 | 1.14 |
| Conradson carbon (%) | 6.45 | 5.99 |

It is seen from the results obtained that the process of this invention is also effective for reducing the contents of an n-heptane insoluble matter, Conradson carbon or nitrogen, and the hydrotreating process in accordance with this invention is also suitable as a process for pretreating raw materials for catalytic cracking, solvent deasphalting, etc.

What we claim is:

1. In a process for hydrotreating a heavy oil containing soluble metals in two steps at a temperature of 320° to 470° C. under a hydrogen pressure of 30 to 350 kg/cm$^2$, the improvement which comprises using a first-step catalyst having a desulfurization selectivity $\gamma_1$ in the first step and a second-step catalyst having a desulfurization selectivity $\gamma_2$, which is lower than $\gamma_1$, in the second step, each of the desulfurization selectivities $\gamma_1$ and $\gamma_2$ being defined by the following equation:

$$\gamma(\text{i.e., } \gamma_1 \text{ or } \gamma_2) = (\ln So/S)/(\ln Mo/M)$$

wherein So and S represent the sulfur contents of the starting heavy oil and the treated oil respectively, and Mo and M represent the metal contents of the starting oil and the treated oil respectively, and maintaining the partial pressure of hydrogen in the first step 10 to 50 kg/cm$^2$ lower than that in the second step.

2. The process of claim 1 wherein said hydrotreatment is carried out at a temperature of 350° to 430° C. and a hydrogen pressure of 70 to 200 kg/cm$^2$.

3. The process of any one of claims 1 or 2 wherein $\gamma_1 \geqq 0.5 > \gamma_2$.

4. The process of claim 3 wherein $0.65 \leqq \gamma_1 < 3$ and $\gamma_2 < 0.5$.

5. The process of one of claims 1 or 2 wherein said second-step catalyst has a carrier containing at least 25% by weight, as oxide, of silicon as a main constituent of its chemical composition, said carrier having a pore volume of at least 0.3 cc/g and an average pore diameter of 100 to 300 A.

6. The process of claim 5 wherein said catalyst carrier is sepiolite or modified sepiolite.

7. The process of one of claims 1 or 2 wherein the partial pressure of hydrogen sulfide in the catalyst layer in the second step is 0.1 to 50 kg/cm$^2$.

8. The process of one of claims 1 or 2 wherein said first-step catalyst comprises an alumina or alumina-silica carrier having a specific surface area of at least 80 m$^2$/g, a pore volume of at least 0.4 cc/g and an average pore diameter of 60 to 200 A, and supported thereon (a) 0.5 to 30% by weight of at least one of V, Mo and W and (b) 0.1 to 12% by weight of Ni or Co or both, the atomic ratio of metal (b) to metal (a) deposited [(b)/(a)] being from 0.1 to 0.8.

9. The process of one of claims 1 or 2 wherein said second-step catalyst comprises at least one member selected from the group consisting of attapulgite, bauxite allophane and red mud.

10. The process of one of claims 1 or 2 wherein the ratio of the content of metals to the content of sulfur in the treated oil is prescribed beforehand by performing the reaction in the first-step catalyst zone under such conditions that the sulfur content of the oil becomes constant, and the reaction in the second-step catalyst zone under such conditions that the metal content in the oil becomes constant.

11. The process of one of claims 1 or 2 wherein said first-step catalyst comprises an alumina or alumina-silica carrier having a specific surface area of at least 80 m$^2$/g, a pore volume of at least 0.4 cc/g and an average pore diameter of 60 to 200 A, and supported thereon (a) 0.5 to 30% by weight of at least one of V, Mo and W and (b) 0.1 to 12% by weight of Ni or Co or both, the atomic ratio of metal (b) to metal (a) deposited [(b)/(a)] being from 0.1 to 0.8, $0.65 \leqq \gamma_1 < 3$ and $\gamma_2 < 0.5$.

* * * * *